US007882714B2

(12) United States Patent
Roberts

(10) Patent No.: US 7,882,714 B2
(45) Date of Patent: Feb. 8, 2011

(54) METHOD OF MANUFACTURING AN ARTICLE OF FOOTWEAR

(76) Inventor: Liana Roberts, 5219 S. Kellen Ct., Bloomfield Hills, MI (US) 48302

( * ) Notice: Subject to any disclaimer, the term of this patent is extended or adjusted under 35 U.S.C. 154(b) by 0 days.

(21) Appl. No.: 12/038,430

(22) Filed: Feb. 27, 2008

(65) Prior Publication Data

US 2009/0211306 A1 Aug. 27, 2009

(51) Int. Cl.
*D04B 1/26* (2006.01)

(52) U.S. Cl. ..... 66/186; 66/178 R

(58) Field of Classification Search ..... 66/186, 66/187, 170, 184, 185, 178 R; 2/239, 269, 2/241, 242

See application file for complete search history.

(56) References Cited

U.S. PATENT DOCUMENTS 482,095 A 9/1892 McClurg
715,543 A 12/1902 Bosworth
1,098,397 A 6/1914 Pecorella
1,798,201 A 3/1931 Hedges
2,219,235 A * 10/1940 Morton ..... 2/239
D143,938 S 2/1946 Schapiro
D172,916 S 8/1954 Ballinger et al.
2,751,693 A 6/1956 Baker
3,049,120 A 8/1962 Marcus
3,128,763 A * 4/1964 Langenfeld et al. ..... 2/239
3,329,972 A 7/1967 Schwab et al.
4,149,274 A 4/1979 Garrou et al.
4,181,982 A 1/1980 Segovia
4,207,880 A 6/1980 Zinkovich
4,253,317 A * 3/1981 Howard et al. ..... 66/186
D271,156 S 11/1983 Williamson
4,475,253 A 10/1984 Laveckis
5,054,129 A 10/1991 Baehr
5,067,179 A 11/1991 Wormser
D341,711 S 11/1993 Askew
D374,764 S 10/1996 Penn
D375,195 S 11/1996 Panassidi
5,617,745 A * 4/1997 Corte et al. ..... 66/178 A
5,623,734 A 4/1997 Pugliatti
D381,465 S 7/1997 Estell
5,749,100 A 5/1998 Rosenberg
D409,824 S 5/1999 Byrd
5,906,007 A 5/1999 Roberts
D414,322 S 9/1999 Asakura
D419,283 S 1/2000 Coito
D420,785 S 2/2000 Perez
6,092,397 A * 7/2000 Cortinovis ..... 66/184

(Continued)

OTHER PUBLICATIONS

Toezies: The Sock for Pilates, Yoga and Lounging Around! Retrieved from the Internet: <URL:www.mytoezies.com/default.asp?PID=3 [Retrieved on Jun. 25, 2008].

(Continued)

*Primary Examiner*—Danny Worrell
(74) *Attorney, Agent, or Firm*—Warner Norcross & Judd LLP

(57) ABSTRACT

A method of forming an article of footwear by forming the article on a glove machine. An article of footwear formed on a glove machine, wherein the article includes a body that includes a leg portion, an ankle portion, and a foot portion.

19 Claims, 2 Drawing Sheets

U.S. PATENT DOCUMENTS

| | | | | |
|---|---|---|---|---|
| 6,158,253 | A * | 12/2000 | Svoboda et al. | 66/178 R |
| D456,124 | S | 4/2002 | Ford | |
| D458,007 | S | 6/2002 | Delinski | |
| 6,418,563 | B1 | 7/2002 | Turner | |
| D476,147 | S | 6/2003 | Campbell | |
| D487,842 | S | 3/2004 | Booker, III | |
| 6,704,941 | B1 | 3/2004 | Palm | |
| D493,030 | S | 7/2004 | Bartee | |
| D498,916 | S | 11/2004 | Lowell | |
| 6,813,910 | B2 * | 11/2004 | Sangiacomo | 66/27 |
| D503,529 | S | 4/2005 | Russell | |
| 6,905,487 | B2 | 6/2005 | Zimmerman | |
| 7,107,626 | B1 | 9/2006 | Andrews | |
| D535,813 | S | 1/2007 | Nooner et al. | |
| D548,951 | S | 8/2007 | Paulin | |
| D558,959 | S | 1/2008 | Kalinsky | |
| 7,346,935 | B1 | 3/2008 | Patterson | |
| 7,346,936 | B2 | 3/2008 | Vargas et al. | |

OTHER PUBLICATIONS

Pedi-Sox: California Weight [Lite] Pedi-Sox. Retrieved from the Internet: <www.originalpedisox.com/ps_products_lite.html [Retrieved on Jun. 25, 2008].

Pedi-Sox: Professional Pedi-Sox, Retrieved from the Internet: <www.originalpedisox.com/ps_products_professional.html [Retrieved on Jun. 25, 2008].

Spa Pedi-Sox: Retrieved from the Internet: <www.originalpedisox.com/ps_products_spa.html [Retrieved on Jun. 25, 2008].

Pedi-Sox: The Original Pedi-Sox. Retrieved from the Internet: <www.originalpedisox.com/ps_products_original [Retrieved on Jun. 25, 2008].

Beech Cozies—Pedicure Sock. Retrieved from the internet: <www.yogasandals.com/wholesale/index.php?main_page=product_info &cPath=2&p . . . [Retrieved on Jun. 25, 2008].

* cited by examiner

METHOD OF MANUFACTURING AN ARTICLE OF FOOTWEAR

BACKGROUND OF THE INVENTION

The present invention relates to the method of manufacturing an article of footwear and the resultant footwear. More specifically, the present invention relates to socks and the manufacture thereof.

Certain situations require that the toes of a person be exposed while the remainder of the foot be covered. For example, in pedicure applications, it is necessary to have access to the toes of the customer and allow the customer to walk while the polish is drying. Other examples include use with open toe shoes, and for medical procedures of the foot, such as the removal of bunions and ingrown toenails or the like, to name just a few.

Numerous innovations regarding toe-less socks are currently available. The typical methodology used to manufacture socks is to knit a sock on a sock machine and remove any toe portions. To date there is no disclosure for a simple and inexpensive process for producing a toeless sock.

SUMMARY OF THE INVENTION

A method of forming an article of footwear by forming the article on a machine capable of forming a sock having a width at the toe section that is greater than the width at the foot section. An article of footwear formed on a machine, wherein the article includes a body that includes a leg portion, an ankle portion, and a foot portion.

These and other objects, advantages and features of the invention will be more fully understood and appreciated by reference to the description of the current embodiment and the drawings.

DESCRIPTION OF THE CURRENT EMBODIMENT

Figure 1:
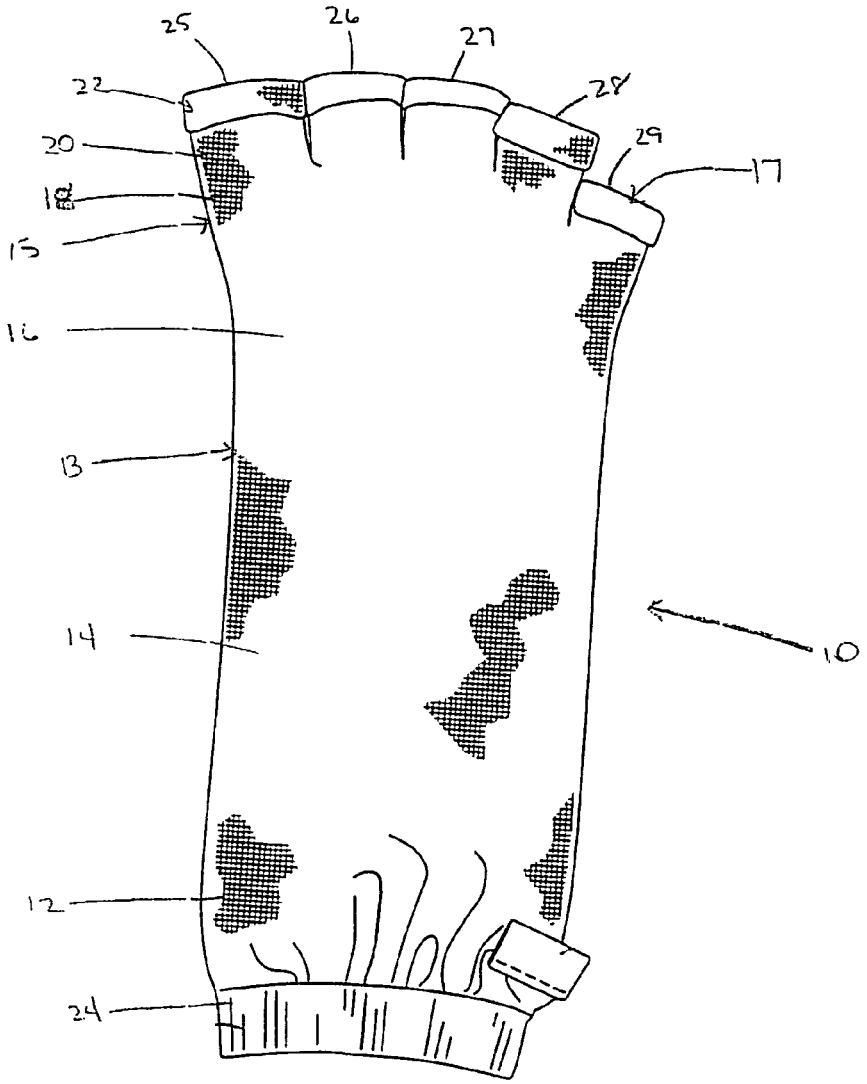
FIG. 1 is a perspective view of a footwear article of the present invention.
Figure 2:
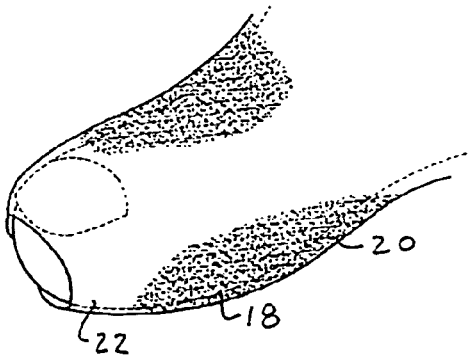
FIG. 2 is a perspective view of a single toe of one of the feet of FIG. 1, showing a toe-covering sheath in an extended position.

Generally, the present invention provides a method of manufacturing articles of footwear. The article of footwear is a sock and is generally illustrated in the Figures at 10.

The article 10 includes a leg portion 12, an ankle portion 14, and a foot portion 16. The leg portion 12 may be of the height illustrated in the Figues or can be longer or shorter, depending upon the intended use. For example, the height of the leg portion 12 may be such that the wearer's calf is covered. The leg portion 12 may also extend higher than the calf. The material used to form the ankle portion 14 is any material known to those of skill in the art to be useful in forming an article of footwear. Examples of such materials include, but are not limited to, cotton, nylon, spandex, cotton blend materials and other materials known for use as a sock. Additionally, the article 10 may be composed from a variety of both natural and synthetic materials. Of particular interest in such application is the cotton material known as Supplex® (trademark DuPont (UK) Ltd.).

The ankle portion 14 can be formed of the same material as that of the leg portion 12, or of another material. The ankle portion 14 extends from the leg portion 12 of the article 10 to the foot portion 16. The size of the ankle portion 14 is sufficient to encompass an ankle therein. The material used to form the ankle portion 14 is any material known to those of skill in the art to be useful in forming an article of footwear. The material should have some flexibility such that the material allows a foot to pass therethrough and then returns to a normal size to closely encompass the ankle.

The foot portion 16 has two ends a first end 13 attached to the ankle portion 14 and a second toe end 15. The toe end includes toe apertures 26,26,27,28,29 such that the sum of the width of the toe apertures 26,26,27,28,29 is greater than the width of the first end 13. In other words, the foot portion 16 is shaped such that the toe end 15 has a width that is wider than the first end 13. The width enables the foot to more comfortably be positioned within the article 10. Additionally, the width enables the article 10 to be manufactured in a manner different that the articles of the prior art.

The foot portion 16 also includes a bottom surface (not shown). The bottom surface can include a plurality of grips. The grips may be composed of a polymerized material of a composition and a consistency so as to provide the user with some gripping function upon use with a smooth surface.

The toe end 15 includes a plurality of apertures 17 sized to enable toes to pass therethrough. Each aperture 17 can further include a toe sheath 18, of which there can be up to five per article 10. The toe sheath 18 is continuous with the foot portion 16. The toe sheath 16 may be manufactured in a continuous process as part of the foot portion 16 or may be manufactured separately from the foot portion 16 and connected to the foot portion 16 afterward. Accordingly, the toe sheaths 18 may be the same or different colors from the leg portion 12, the ankle portion 14, and the foot portion 16. It is also possible to make the toe sheaths 18 from a material that is different from that of the rest of the article, as may be desired for warmth, support, or to improve the wear-resistance of the toe sheaths 18. The size of the toe sheath 18 can also vary. For example, the toe sheath 18 may extend partially beyond the end of the foot portion 16 or can extend substantially beyond the end, such that the sheath 18 can cover the entire toe. In such an embodiment, the material used to form the sheath 18 must be able to be folded, so that the toe sheath 18 can optionally be folded back onto itself.

The sheath 18 includes a body portion 20 and a tip portion 22. The tip portion 22 can substantially cover the toe. The tip portion 22 can also extend beyond the end of the toe such that none of the toe is revealed. It is in an unfolded condition that the wearer would use the article 10 prior to receiving the pedicure or subsequent to the substantially complete drying of the nail polish, when the tip portion 22 is in its unfolded state. The article 10 may be used in any manner in which a stocking can be worn, such as with a shoe or with a sandal.

Figure 3:
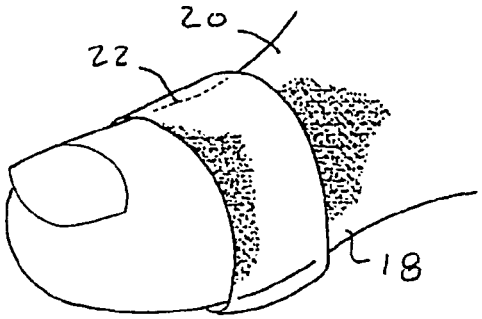
FIG. 3 is a perspective view of a single toe of one of the feet of FIG. 1, showing a toe-covering sheath in a folded position.
Figure 4:
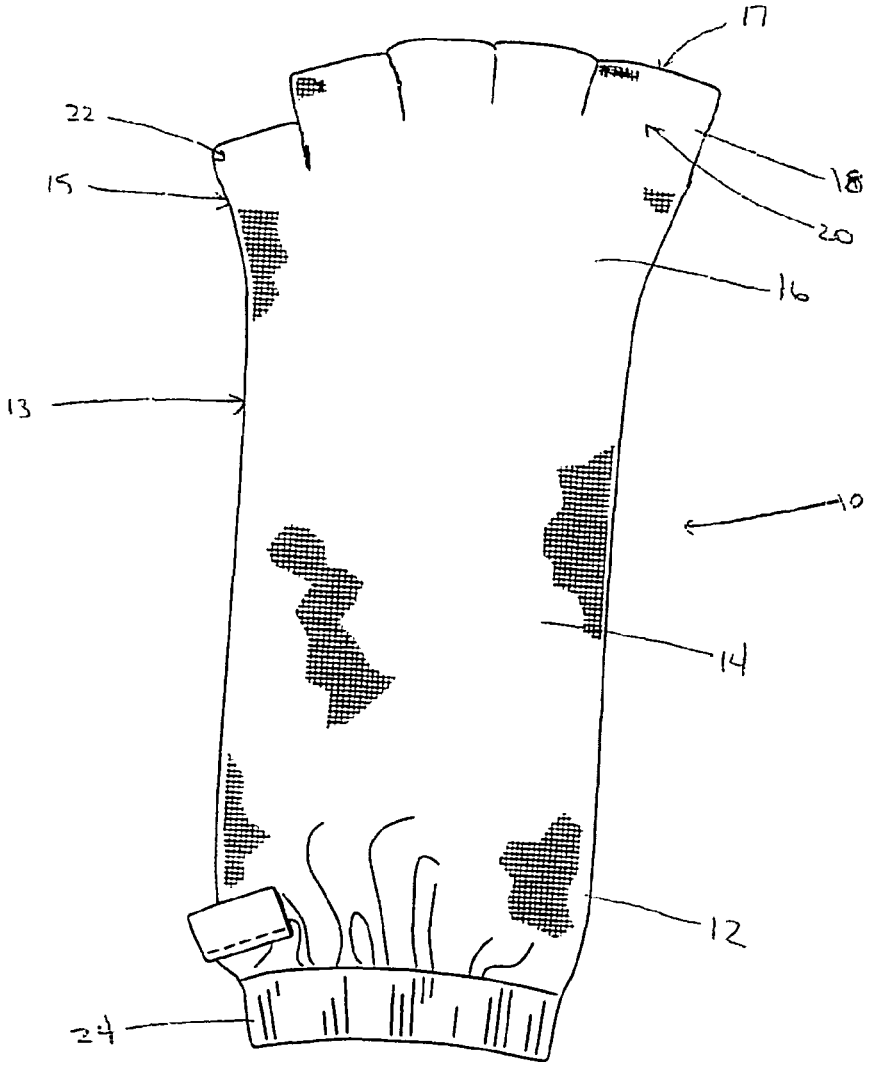
FIG. 4 is a perspective view of a alternative embodiment of the footwear article of the present invention.

To make the toe accessible for manicuring and polishing, the wearer simply folds or rolls the tip portion 22 of the sheath 18 back toward the portion 16 of the article 10 as shown in FIGS. 3 and 4. In this position, the tip portion 22 is folded back onto the body portion 20 of the toe sheath 18. The toenail is fully exposed for manicuring and polishing. This position also allows the rolled-up sheath 18 to separate the toes as may be desired. After the polish has sufficiently dried, the tip portion 22 is unfolded back to its extended position and the article may thus be worn until such time as the user elects to remove it in favor of more conventional footwear.

The leg portion 12 includes an elastic retaining band portion 24 that aids in retaining the leg portion 12 against a wearer's calf or other portion of the leg. The end 26 of the elastic retaining band portion 24 is rolled inward and sewn. This aids in preventing the band portion 24 from fraying during use, therein increasing durability.

The article 10 of the present invention is made on any machine capable of forming a sock having a width at the toe section that is greater than the width at the foot section. For example, the machine can be a glove machine. The glove machine enables the sock to have the design wherein the toe end 15 of the article 10 is wider that the first end 13. The sock is formed using the standard methods known to those of skill in the art for forming a glove, and using materials that can either be used for gloves or for socks, but the resultant article is the article 10 of the present invention.

The above description is that of the current embodiment of the invention. Various alterations and changes can be made without departing from the spirit and broader aspects of the invention as defined in the appended claims, which are to be interpreted in accordance with the principles of patent law including the doctrine of equivalents. Any reference to a claim element in the singular, for example, using the articles "a," "an," "the" or "said," is not to be construed as limiting the element to the singular.

The embodiments of the invention in which an exclusive property or privilege is claimed are defined as follows:

1. A method of forming a sock with a glove machine comprising:

forming a toe section of the sock having a first width with the glove machine and a foot section of the sock having a second width with the glove machine;

forming a plurality of toe sheaths adjacent the toe section, each of the plurality of toe sheaths including a tip portion and a body portion, the body portion being joined with the toe section;

forming a toe aperture in the tip portion of each of the plurality of toe sheaths, the plurality of toe apertures each having an individual width, wherein a sum of the individual widths of the plurality of toe apertures equal a third width, wherein the first width is greater than the second width when the sock is without a foot of a user positioned therein, and wherein the third width is greater than the second width when the sock is without a foot of a user positioned therein.

2. The method according to claim 1, wherein said forming step includes knitting the sock on the glove machine.

3. The method according to claim 2, comprising forming the tip portion of the sock adjacent the toe aperture so that the tip portion is rearwardly foldable over the body portion of the respective sheath.

4. The method according to claim 1, comprising forming a gripping means on an underside of the foot section.

5. The method according to claim 4, comprising forming a gripping means on an underside of at least a portion of the toe section.

6. A sock comprising:

a toe section joined to a foot portion, the toe section having a first width and the foot portion having a second width;

a plurality of toe sheaths adjacent the toe section, each of the plurality of sheaths including a tip portion and a body portion, the body portion being joined with the toe section;

a toe aperture in the tip portion of each of the plurality of toe sheaths, the plurality of toe apertures each having an individual width, wherein a sum of the individual widths of the plurality of toe apertures equal a third width, wherein the first width is greater than the second width when the sock is without a foot of a user positioned therein, and the third width is greater than the second width when the sock is without a foot of a user positioned therein.

7. The sock according to claim 6, wherein said sock is a knitted sock.

8. The sock according to claim 6, wherein said sock is formed of a material selected from the group consisting essentially of cotton, nylon, spandex, and combinations thereof.

9. The sock according to claim 6, wherein said sock comprises a body, said body including a leg portion, an ankle portion, and the foot portion.

10. The sock according to claim 9, wherein said toe section includes at least one body portion and at least one tip portion, said at least one tip portion being movable between an extended unfolded position and a folded position.

11. The sock according to claim 10, wherein said body and said toe section are composed of a stretchable material.

12. The sock according to claim 10, wherein said body is composed of a first material and said toe section is composed of a second material, said first and second materials being different.

13. The sock according to claim 10, wherein said at least one body portion and said at least one tip portion substantially cover a user's toe when said at least one tip portion is in said extended unfolded position.

14. The sock according to claim 10, wherein said at least one tip portion is positioned adjacent said at least one body portion when said at least one tip portion is folded thereover.

15. The sock according to claim 9, wherein said foot portion includes an underside and wherein said underside is fitted with means for gripping.

16. The sock according to claim 15, wherein said means for gripping is defined by a plurality of grips fitted to said underside of said foot portion.

17. The sock according to claim 16, wherein said means for gripping is a sole portion which substantially covers said underside of said foot portion.

18. The sock according to claim 17, wherein said sole portion further substantially covers said toe section.

19. A method of forming a sock comprising:

forming a toe section of the sock having a first width with a glove machine and a foot section of the sock having a second width with the glove machine;

attaching a plurality of toe sheaths adjacent the toe section, each of the plurality of toe sheaths including a tip portion and a body portion, the body portion being joined with the toe section;

forming a toe aperture in the tip portion of each of the plurality of toe sheaths, the plurality of toe apertures having an individual width, wherein a sum of the individual widths of the plurality of toe apertures equal a third width, wherein the first width is greater than the second width when the sock is without a foot of a user positioned therein, wherein the third width is greater than the second width when the sock is without a foot of a user positioned therein, and wherein the tip portion of each of the plurality of toe sheaths are adapted to be rolled rearwardly onto the body portion of the respective sheath.

* * * * *